US005822167A

United States Patent [19]

Schmitz

[11] Patent Number: 5,822,167

[45] Date of Patent: Oct. 13, 1998

[54] METHOD OF ADJUSTING AN ELECTROMAGNETIC ACTUATOR

[75] Inventor: Günter Schmitz, Aachen, Germany

[73] Assignee: FEV Motorentechnik GmbH & Co. KG, Aachen, Germany

[21] Appl. No.: 941,061

[22] Filed: Sep. 30, 1997

[30] Foreign Application Priority Data

Oct. 7, 1996 [DE] Germany ..... 196 41 244.7

[51] Int. Cl.[6] ..... H01H 47/04

[52] U.S. Cl. ..... 361/143; 361/210; 324/418

[58] Field of Search ..... 361/143, 152–156, 361/160, 170, 206, 210; 324/418; 340/644

[56] References Cited

U.S. PATENT DOCUMENTS 4,455,543 6/1984 Pischinger et al. .
4,544,986 10/1985 Buchl ..... 361/152
5,256,973 10/1993 Thee et al. ..... 324/418
5,477,149 12/1995 Spencer et al. ..... 324/418
5,548,210 8/1996 Dittrich ..... 324/418
5,650,909 7/1997 Remele et al. ..... 361/154

*Primary Examiner*—Fritz Fleming
*Attorney, Agent, or Firm*—Spencer & Frank

[57] ABSTRACT

A method of adjusting the position of rest of an armature of an electromagnetic actuator, reciprocated against the force of resetting springs by an alternating energization of two spaced electromagnets; the position of rest being assumed by the armature in the de-energized state of the two electromagnets. The method includes the steps of detecting and determining actual values of an impact indicator representing an impact behavior of the armature as the armature impacts on the pole face of the capturing electromagnet; comparing the actual values derived from both electromagnets with predetermined desired values to form deviation values between the actual and the desired values; and, if deviation values are present, shifting the position of rest of the armature by an adjusting device until the actual values derived from both electromagnets correspond to a predetermined desired value.

4 Claims, 4 Drawing Sheets

METHOD OF ADJUSTING AN ELECTROMAGNETIC ACTUATOR

CROSS REFERENCE TO RELATED APPLICATION

This application claims the priority of German Application No. 196 41 244.7 filed Oct. 7, 1996, which is incorporated herein by reference.

BACKGROUND OF THE INVENTION

Electromagnetic actuators such as used, for example, in piston-type internal-combustion engines for operating the cylinder valves are required to work with high switching velocities and, at the same time, with large switching forces. Particularly for operating cylinder valves in internal combustion engines, the electromagnetic actuator has an armature which is attached to the setting member to be actuated, that is, a cylinder valve of the engine. The armature is maintained in a position of rest between two electromagnets by two oppositely working resetting springs. The armature, upon energization of the electromagnets, is alternatingly attracted by the electromagnets—one of which operates as a closing magnet and the other as a opening magnet—from the position of rest and is, for the duration of the current flow in the momentary holding magnet, maintained in the closed position or open position.

For operating the cylinder valve, that is, for initiating its motion from the closed position into the open position or conversely, the holding current at the holding magnet is switched off. As a result, the holding force of that electromagnet drops below the spring force of the resetting spring and the armature begins its motion, accelerated by the spring force. After the armature traverses its position of rest, its "flight" is braked by the spring force of the oppositely located resetting spring. To ensure that the armature is captured in its other position, the respective other electromagnet (then the capturing electromagnet) is energized.

The use of electromagnetic actuators for cylinder valves is advantageous in that an adaptable control for the intake and exhaust of the work medium is possible so that the work process may be optimally affected by the parameters desired by the engine operation. The course of the control has a significant influence on various operational parameters, for example, the conditions of the work medium in the intake zone, in the work chamber and in the exhaust zone as well as the processes in the work chamber itself. Since piston-type internal-combustion engines operate in a non-stationary manner under widely varying operational conditions, a corresponding variable control of the operation of the cylinder valves is of advantage. Such an electromagnetic switching system for cylinder valves is disclosed, for example, in U.S. Pat. No. 4,455,543.

A significant problem encountered in the control of electromagnetic actuators of the above-outlined type is the timing accuracy which is required particularly for the intake valves in an internal-combustion engine for controlling the engine output. An accurate control of the time periods is made more difficult by manufacturing tolerances, by wear during operation as well by various operational conditions, for example, alternating load requirements and alternating working frequencies, because such outer influences may affect relevant timing parameters of the system. A condition for a precise and reliable operation of the cylinder valves is the setting of the position of rest of the armature. A setting of the "static position of rest" of the armature between the two electromagnets in case of deenergized coils is not satisfactory even when the spring forces and the inductivities of the magnets are taken into account.

To operate an electromagnetic actuator of the above-outlined type with a satisfactory timing accuracy, the "dynamic position of rest" of the armature is of significance. In this connection in the armature motion into the open and closed valve position various frictional resistances and/or gas forces have to be considered which affect the symmetry of the motion process. Such a symmetry is decisively affected by the position of rest of the armature. If the position of rest is shifted, the armature has different amplitudes in the two directions of motion. To ensure in case of a shifted position of rest that at both ends of its travel path the armature is securely captured by the momentary holding magnet, either the holding current for the two magnets should be set differently, or for both electromagnets identical currents are set to such a magnitude that the armature is securely captured at both ends. In the latter solution, however, the armature impacts with a significantly higher velocity against that magnet towards which the position of rest has shifted.

In case of an asymmetrical motion behavior, the position of rest must be set off-center accordingly to ensure that the operation proceeds with an optimal utilization of energy and thus also with an accurate timing. In an internal-combustion engine it is important to set correctly, that is, uniformly, the position of rest of all cylinder valves of the same type.

Further, in operation, the frictional resistances, for example, the damping of motion caused by the alternating gas force, are load-dependent to a substantial extent. For the one-time setting during manufacture and service, to be sure, a defined operational point may be determined so that such an effect plays no role for the setting proper. The setting may also be effected during a "non-fired" run. In the actual operation the asymmetries are eliminated by an unlike current supply of the opening and closing magnet at medium or high loads.

Because of the above-outlined reasons, it is not possible to run the engine in all operating points in an "energy-optimal" manner in case of a fixed setting of the position of rest. Therefore, for a fixed setting of the position of rest a criterion has to be determined while considering the operational reliability and the favorable run from an energy point of view such that the requirement set for the engine (load assemblies in testing cycles, etc.) is taken into consideration.

Another possibility resides in that the position of rest during operation is adapted in each instance to the requirements of the operating point. Thus, for example, at an operating point of higher load in which the armature during the opening of the exhaust valve is particularly strongly "braked", the position of rest is shifted in the direction of the open side.

A first setting of the position of rest must be performed immediately following the completion of the final assembly. In order to be able to test the correct setting of the position of the armature, a measuring value must be available which gives an appropriate indication of the armature position. Since the armature proper is no longer accessible after final assembly, a verification of the position of rest is very difficult by mechanical means. Furthermore, as outlined earlier, the geometric position of rest is not necessarily identical to the dynamic position of rest in case the springs have a certain progressiveness and/or unlike frictional conditions are present.

A correct setting of the position of rest normally does not shift during operation. Nevertheless, the position of rest may shift in case of a faulty functioning. This requires the availability of a diagnostic function which supplies information concerning the condition of the armature setting.

SUMMARY OF THE INVENTION

It is an object of the invention to provide an improved method of adjusting an electromagnetic actuator, making possible an automated detection of the position of rest and displaying as well as diagnosing faulty settings.

This object and others to become apparent as the specification progresses, are accomplished by the invention, according to which, briefly stated, the method of adjusting the position of rest of an electromagnetic actuator armature reciprocated against the force of resetting springs by an alternating energization of two spaced electromagnets, includes the steps of detecting and determining actual values of an impact indicator representing an impact behavior of the armature as the armature impacts on the pole face of the capturing electromagnet; comparing the actual values derived from both electromagnets with predetermined desired values to form deviation values between the actual and the desired values; and, if deviation values are present, shifting the position of rest of the armature by an adjusting device until the actual values derived from both electromagnets correspond to a predetermined desired value.

The desired value may be predetermined by the fact that the impact indicators are identical for the two magnets or a detected difference corresponds to a predetermined magnitude. As an impact indicator the course of the current and/or the course of the voltage at the coil of the momentary capturing magnet may be given or a selected characteristic of the current or voltage curve, for example, a local maximum, the moment of the maximum, or the like may be given. According to another feature of the invention, the impact sound (body sound) generated as the armature impacts on the pole face of the capturing magnet is detected and used as an impact indicator.

DESCRIPTION OF THE PREFERRED EMBODIMENT

Figure 1:
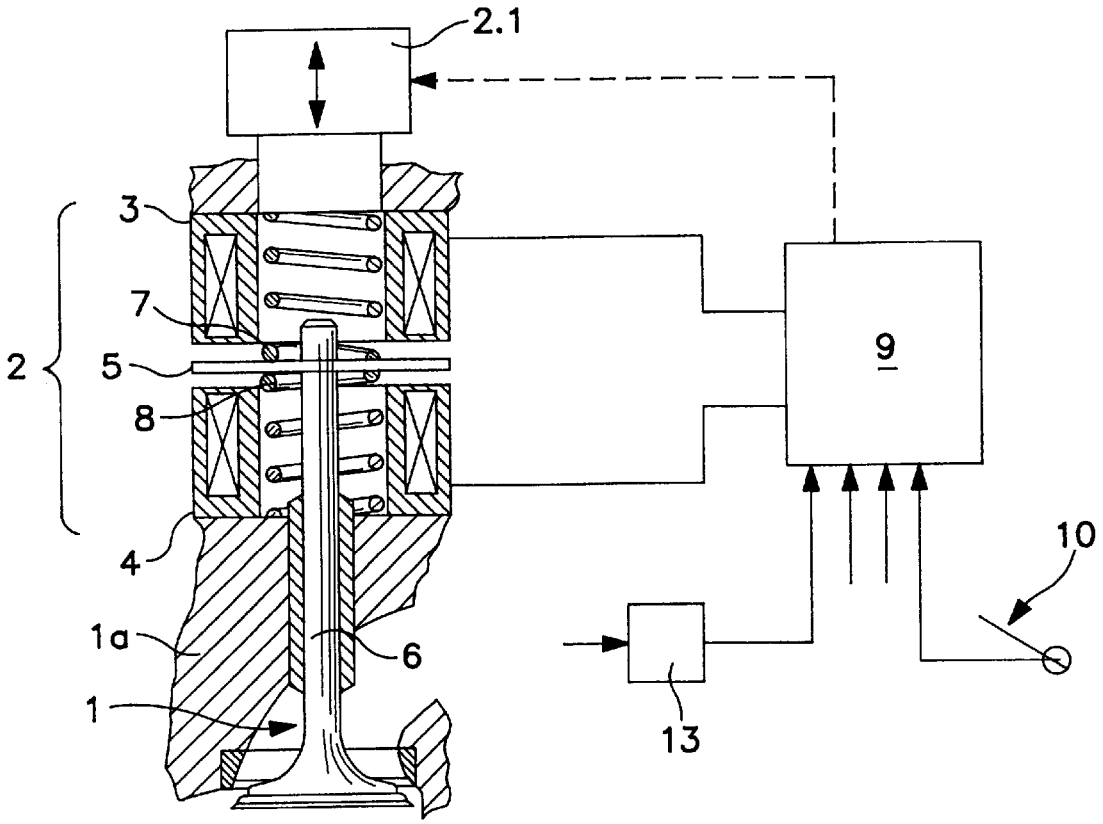
FIG. 1 is a schematic axial sectional view of an electromagnetic actuator and control for a cylinder valve.

FIG. 1 shows a tappet valve 1 supported in a cylinder head 1*a* of a piston-type internal-combustion engine. The valve 1 is operated by an electromagnetic valve drive (actuator) 2 which has two spaced electromagnets 3 and 4 between which an armature 5 is supported for reciprocating motion. The armature 5 is attached to the valve stem 6 and, when the electromagnets are in a de-energized state, is held in a mid position between the two electromagnets 3 and 4 by a resetting spring 7 associated with the electromagnet 3 and a resetting spring 8 associated with the electromagnet 4. The position of rest of the armature 5 may be adjusted by means of a setting device 2.1 which may manually or automatically actuated. The setting device 2.1 may be, for example, an axially adjustable spring seat for the spring 7 to thus adjust the axial location where the forces of the counteracting spring 7 and 8 are in equilibrium. Such a location determines the position of rest for the armature 5. If the electromagnet 3 is energized, the armature 5 is attracted thereto and eventually lies against the pole face of the electromagnet 3 so that the valve 1 is held in its closed position. If, on the other hand, the electromagnet 3 is de-energized and the electromagnet 4 is energized, the armature 5 moves, first accelerated by the force of the resetting spring 7, towards the electromagnet 4 and is thereafter captured by the latter so that the armature 5 lies against the pole face of the electromagnet 4 and holds the valve 1 in its open position.

The valve 1 may function as an intake valve or an exhaust valve in an internal-combustion engine in which each cylinder has at least one intake valve and one exhaust valve. The actuation of the individual intake valves and exhaust valves in an internal-combustion engine is effected with electromagnetic valve actuators of the above-described type, which, in turn, are operated by an electronic engine control 9. Apart from the desired load conditions set by the accelerator pedal 10, the engine control 9 receives signals representing the crankshaft rpm, the crankshaft angle, the engine temperature and other data as basic initial values relevant or desired for a satisfactory engine run. These data are processed by the engine control 9 and the resulting setting signals are applied for effecting an alternating energization of the electromagnets of the individual actuators for the respective cylinder valves.

Figure 2A:
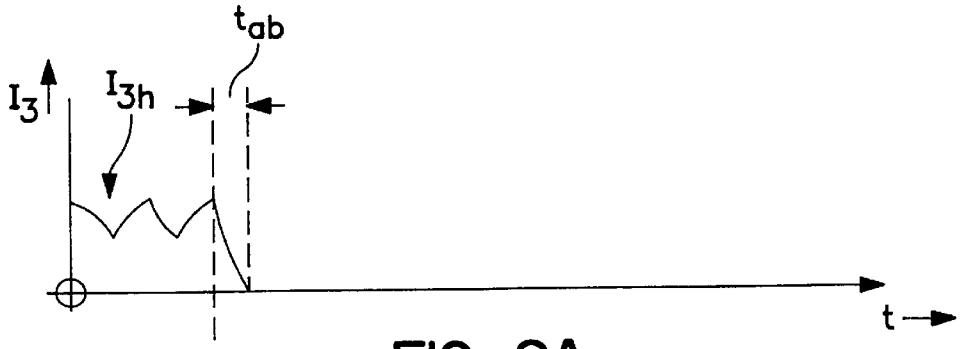
FIG. 2 illustrates diagrams of current and displacement curves during operation of the actuator.
Figure 2B:
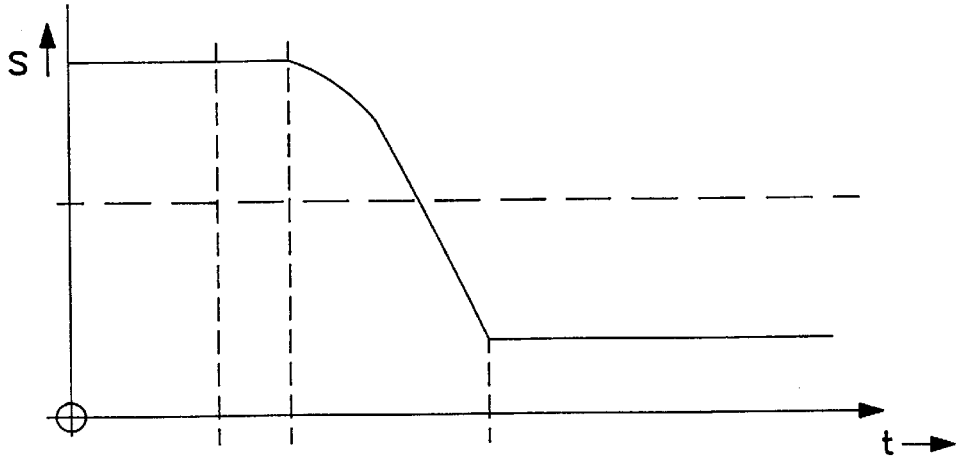
Figure 2C:
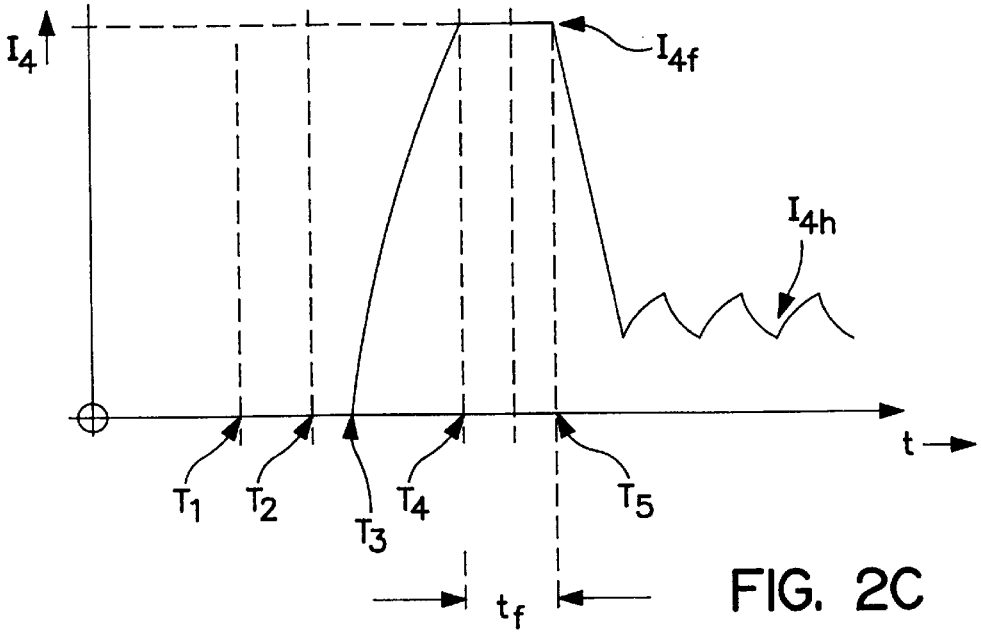

FIG. 2 shows the current curves of the energizing current in the two electromagnets (upper and lower diagram) as well as the displacement curve of the armature 5 (middle diagram).

As an initial position for the representation in FIG. 2, it is assumed that the armature 5 lies at the pole face of the electromagnet 3, that is, the tappet valve 1 is held in its closed position against the force of the resetting spring 7. To be able to maintain the armature 5 at the electromagnet 3, the latter is energized with a holding current $I_{3h}$ which is "cycled" between an upper and lower current value to reduce the current consumption during the holding phase by utilizing the stored magnetic energy.

To open the valve 1, the electromagnet 3 is de-energized at moment $T_1$. As a result, the holding current drops during a period of $t_{ab}$ and thus the armature, even after the complete disappearance of current flow, dwells at the electromagnet 3 during a "sticking" period, caused by the effect of a residual magnetic flux. The armature 5 start its motion only at moment $t_2$, urged by the force of the resetting spring 7 as it may be observed from the displacement curve of the armature (middle diagram in FIG. 2). As soon as the armature 5 has traversed the mid position predetermined by the counteracting forces of the two resetting springs 7 and 8, the armature motion is opposed by the increasing force of the resetting spring 8. To ensure, however, that the armature 5 is "captured" by the electromagnet 4 and the valve 1 is maintained securely in the open position, at moment $t_3$ the electromagnet 4 is energized so that the maximum capturing current $I_{4f}$ is reached even before the armature 5 impacts on the pole face of the electromagnet 4 at moment $T_4$. This maximum capturing current is maintained throughout a predetermined period $t_f$ until the moment $T_5$. The period $t_f$ is of such a length that a secure impacting of the armature 5 on the pole face of the electromagnet 4 is obtained. At the moment $T_5$ the current is reduced to the magnitude of the holding current $I_{4h}$ and during the holding period the holding current $I_{4h}$ is cycled about upper and lower values for reducing current consumption. For closing the valve 1, the electronic engine control 9 switches off the holding current $I_{4h}$ so that the earlier-described current conditions and valve motion occur in a reverse sense.

It will be readily apparent that the impact speed of the armature 5 on the pole face of the momentarily capturing electromagnet will be different in case of an equal magnitude of the capturing current $I_f$ if the position of rest of the armature 5 is not accurately set. In the end phase of its approach to a magnet pole face the armature undergoes a correspondingly greater acceleration than during an approach of the other pole face so that, as a result, the armature impacts with different speeds on the one and the other pole face of the opposite electromagnets.

The unlike speeds of the armature 5 shortly before it impacts on the one and the other pole face may be recognized by comparing the current or voltage courses of the coil of the momentarily capturing magnet.

Figure 3A:
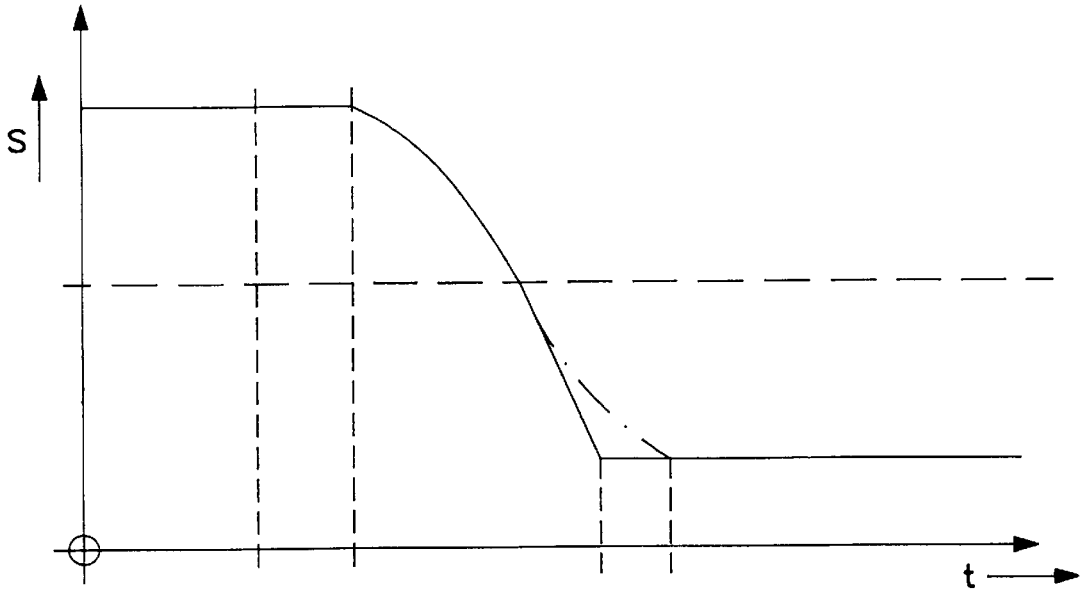
FIG. 3 illustrates diagrams showing the detection of different impact velocities by the voltage curve of the capturing electromagnet.
Figure 3B:
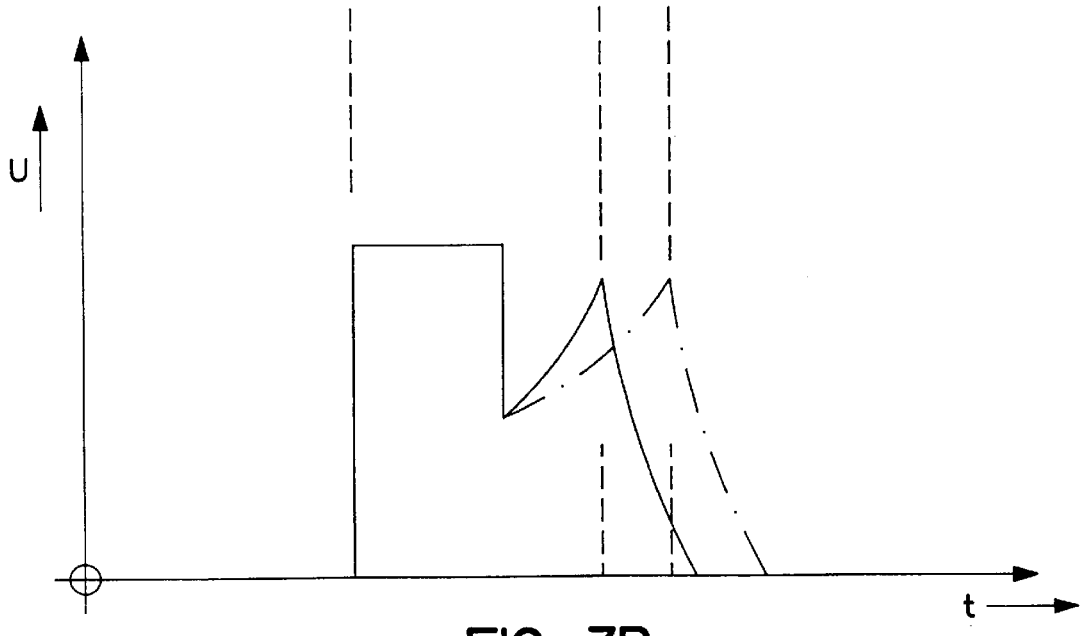

In FIG. 3, the upper diagram shows the displacement curve of the armature 5, similarly to the middle diagram in FIG. 2. The displacement curve of FIG. 3 shows two situations: first, a "hard" impacting illustrated in solid lines where an angular break in the displacement path of the armature is shown and a "soft" impacting which is illustrated in a dash-dot curve portion, smoothening the transition of the armature displacement from motion to standstill. The "hard" impacting means that at given identical current intensities at the momentarily capturing magnet the armature needs to overcome a smaller resistance and therefore impacts on the pole face sooner, while the "soft" impacting of the armature means that a higher resistance has to be overcome and accordingly the impacting on the pole face occurs later and with a lesser speed. In case the conditions for both capturing magnets are the same, then identical displacement curves are obtained so that it may be stated that in case of the actuator under examination the position of rest of the armature 5 has been correctly set.

If, however, the position of rest of the armature is not properly set, unlike displacement curves are obtained upon comparison.

While the course of displacements cannot be detected directly, it is nevertheless feasible to determine the course of the voltage at the capturing magnet in case of a current regulation as described in connection with FIG. 2 and as shown schematically for the current curve in FIG. 3. While the capturing current is maintained constant during the time period where the moment of impact is expected, the motion of the armature which approaches the pole face generates a voltage change in the respective magnet coil. As shown in FIG. 3, the voltage falls as the constant current phase begins. As soon as the armature approaches the pole face, however, a voltage increase again occurs. This increase is proportionate to the motion speed of the impacting armature so that in case of a hard impacting a steeper voltage course may be ascertained than in case of a soft impacting. In FIG. 3, the voltage curve is illustrated in solid lines to indicate the hard impacting, while the dash-dot line indicates the soft impacting. The course of the voltage may be detected across the solenoid of the momentarily capturing magnet so that it is possible to perform a direct comparison between the two voltage curves of the momentarily capturing magnets and in case of deviations, a suitable adjustment of the position of rest of the armature may be made for the actuator under examination.

Figure 4A:
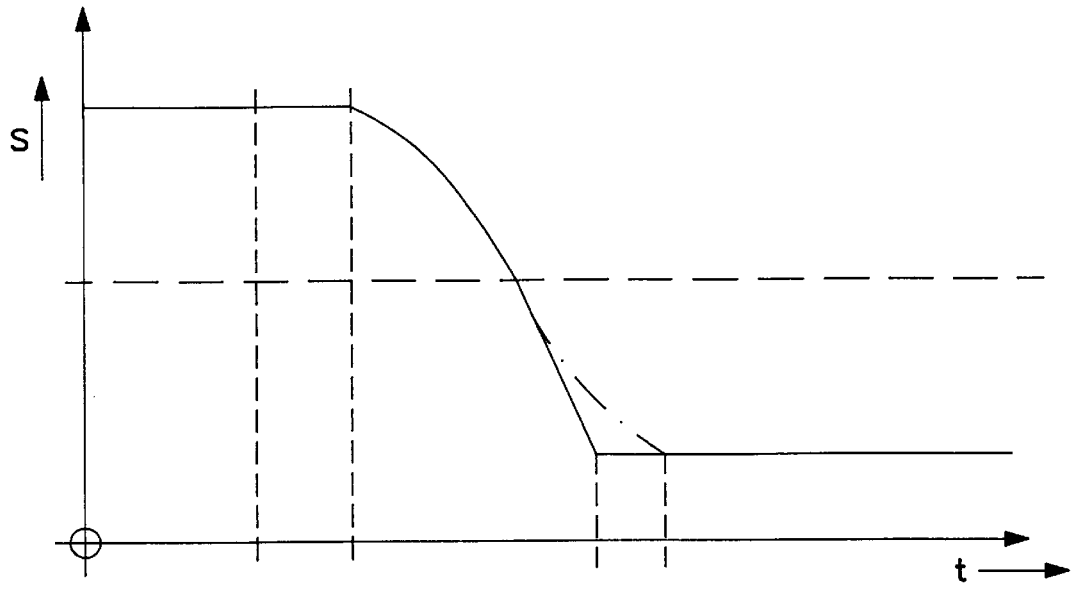
FIG. 4 are diagrams illustrating the detection of different impact velocities by the current curve of the capturing electromagnet.
Figure 4B:
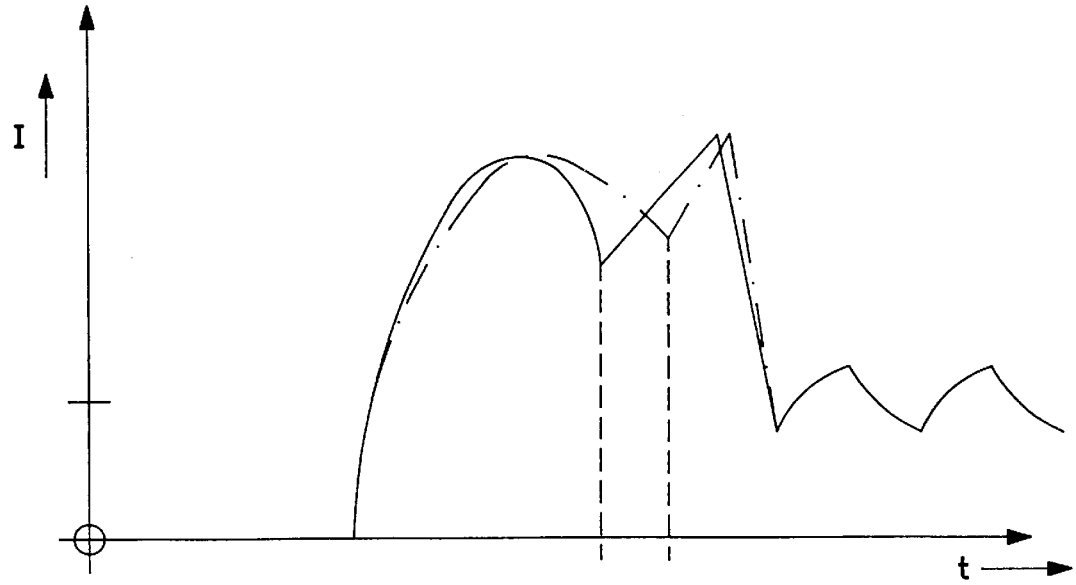

FIG. 4 illustrates the differences in the current curve at the momentarily capturing magnet in case of different impacting speeds if at the capturing magnet the capturing current at moment $T_3$ (FIG. 2) is regulated to its high value without constant limiting and at an expected moment, shortly after the armature impacts on the pole face, the current is reduced to the holding current $I_h$. The solid line again indicates the course of the capturing current in case of a hard impacting, while the dash-dot line of the current curve shows a soft impacting. Based on the significant differences it is also possible to make predictions by direct comparison of the two curves concerning a correct setting of the position of rest and, in case of deviations at the actuator, to adjust the position of rest of the armature such that the current curves in both magnets are substantially identical.

Since as the armature impacts on the pole face, the kinetic energy of the armature is converted to a force effect on the pole face and thus sound is generated, as a modification of the process according to the invention it is feasible to detect the moment of impact and the impact energy by sound measurement. Since in case of a correctly set position of rest the energy conversion is identical for both capturing electromagnets, the sound generated in the actuator necessarily must also be the same. In case deviations are present, a corresponding setting signal may be generated and thus the position of rest of the armature may be shifted manually or automatically by means of a setting device (such as device 2.1 in FIG. 1), until the energy conversion, that is, the sound generation is identical at both capturing electromagnets.

Figure 5:
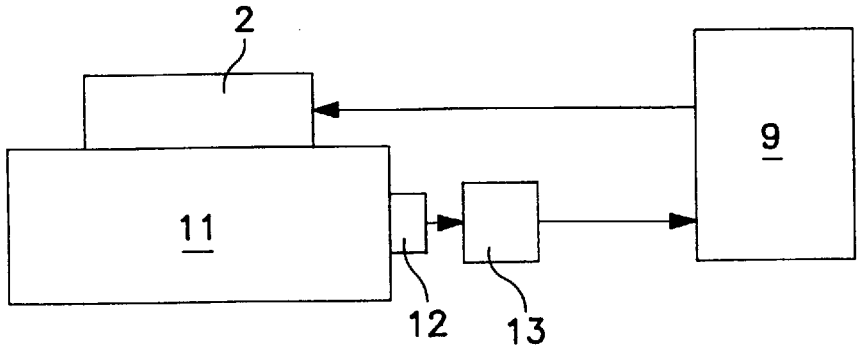
FIG. 5 is a block diagram illustrating an arrangement for detecting the impact sound generated upon impact of the armature on a magnet pole.

FIG. 5 shows a block diagram which illustrates the basic principle of operation. A piston-type internal-combustion engine 11 is provided with a required number of tappet valves, each associated with an electromagnetic valve actuator 2, illustrated collectively as a block. For testing the actuators 2, a central sensor 12 or, for each actuator a separate sensor 12 is provided for detecting the oscillation signal generated as the armature impacts on the respective pole face. The oscillation signal detected by the sensor 12 is evaluated in an evaluating unit 13 as concerns the amplitude symmetry at the pole faces of the two oppositely located electromagnets. In case a deviation is present, that is, the armature impacts with a higher speed on the pole face of one capturing electromagnet than on the other, based on a correcting signal which is displayed by the evaluating unit 13, the setting device 2.1 (FIG. 1), operated manually or automatically by means of the control 9, adjusts the position of rest of the armature.

In case a sound detector is associated with each electromagnetic valve actuator, the "body sound" impact indicator may be detected separately for each valve. In case a sole sound detector is utilized for the engine, the evaluating unit 13 and/or the associated display device must be triggered by an additional signal representing the rotary angle of the crankshaft. Thus, each signal detected by the sound detector 12 may be associated with a particular actuator, based on the angular position of the crankshaft.

The magnitude of the sound signals depends on the impact speed. In case of small impact speeds only a small signal and in higher speeds a larger signal is obtained. Cyclic oscillations in the signal which may occasionally appear, for example, because of a somewhat different kind of arrival of the armature on the pole face may be eliminated by averaging over several cycles. The values ascertained at the opening and closing side for the impact speeds may be, for example, after an evaluation by comparison with a predetermined characteristic curve, subtracted from one another or, in the alternative, a ratio may be formed. The result is compared with a desired value and in this manner the extent of the faulty setting is found.

The determined magnitude of the faulty setting is displayed by a diagnostic indicator to the mechanic who then changes the position of rest of the armature by means of a suitable setting device. At the end of the setting process or even during the setting process, the position of rest is tested again as described above. If a deviation from the desired setting is still present, a further adjustment is performed and this process is repeated until the correct setting is found. In the ideal case, however, only a single setting process is necessary because the process also makes possible an indication of the extent of the faulty settings. This process may also be automated by appropriately designing the setting device 2.1, for example, by providing it with a motor operated by the control 9. Or, the setting may be effected by an externally connected work shop diagnostic system.

Also, selected particular characteristics of impact indicators may be used for the evaluation. Thus, it is expedient to detect an amplitude within a predetermined "time window" or within a predetermined crankshaft displacement angle range and to use the same for the comparison. It is also feasible to utilize as a comparison value the maximum amplitudes, the moment of impact of the maximum amplitudes or the integral derived from the course of the detected impact indicator.

In case body sound is used as the impact indicator, expediently the magnitude of the sound energy is detected; in this case too, maximum values relating to time and/or crankshaft angle may be utilized for the comparison.

It will be understood that the above description of the present invention is susceptible to various modifications, changes and adaptations, and the same are intended to be comprehended within the meaning and range of equivalents of the appended claims.

What is claimed is:

1. A method of operating an electromagnetic actuator including two spaced electromagnets each having a pole face, an armature movable back-and-forth between the pole faces, resetting springs exerting a force on the armature and maintaining the armature in a position of rest at a location spaced from the pole faces in a de-energized state of the two electromagnets and adjusting means for shifting the position of rest; the method comprising the following steps:

(a) alternatingly energizing the electromagnets for attracting the armature to and holding the armature at the pole face of the energized electromagnet, acting as a capturing electromagnet, against the force of a respective resetting spring;

(b) detecting and determining actual values of an impact indicator representing an impact behavior of the armature as the armature impacts on the pole face of the capturing electromagnet;

(c) comparing said actual values derived from both electromagnets with predetermined desired values to form deviation values between the actual and the desired values; and (d) if deviation values are present, shifting the position of rest of the armature by the adjusting means until the actual values derived from both electromagnets correspond to a predetermined desired value.

2. The method as defined in claim 1, wherein said impact indicator is the voltage/time curve of the capturing electromagnet.

3. The method as defined in claim 1, wherein said impact indicator is the current/time curve of the capturing electromagnet.

4. The method as defined in claim 1, wherein said impact indicator is an impact sound generated upon impacting of the armature on the pole face of the capturing electromagnet.

* * * * *